US010245848B2

(12) United States Patent
Horie et al.

(10) Patent No.: US 10,245,848 B2
(45) Date of Patent: Apr. 2, 2019

(54) PRINTING APPARATUS

(71) Applicant: SEIKO EPSON CORPORATION, Tokyo (JP)

(72) Inventors: Seijun Horie, Matsumoto (JP); Atsushi Majima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/805,637

(22) Filed: Nov. 7, 2017

(65) Prior Publication Data

US 2018/0126754 A1 May 10, 2018

(30) Foreign Application Priority Data

Nov. 10, 2016 (JP) ..... 2016-219430

(51) Int. Cl.

| | |
|---|---|
| ***B41J 2/175*** | (2006.01) |
| ***B41J 11/00*** | (2006.01) |
| ***B41J 2/165*** | (2006.01) |
| ***B41J 29/377*** | (2006.01) |

(52) U.S. Cl.

CPC ..... *B41J 11/0015* (2013.01); *B41J 2/16535* (2013.01); *B41J 2/175* (2013.01); *B41J 11/002* (2013.01); *B41J 29/377* (2013.01)

(58) Field of Classification Search

CPC ..... B41J 2/16535; B41J 2/175; B41J 11/002; B41J 29/377; B41J 11/0015

See application file for complete search history.

(56) References Cited

U.S. PATENT DOCUMENTS

| | | | |
|---|---|---|---|
| 2005/0206676 | A1 | 9/2005 | Ishii et al. |
| 2014/0291438 | A1 | 10/2014 | Horie |

FOREIGN PATENT DOCUMENTS

| | | | |
|---|---|---|---|
| JP | 2002-359479 | A | 12/2002 |
| JP | 2005-212160 | A | 8/2005 |
| JP | 2007-090747 | A | 4/2007 |
| JP | 2007-105927 | A | 4/2007 |
| JP | 2007-160854 | A | 6/2007 |
| JP | 2014-195899 | A | 10/2014 |
| JP | 2015-178261 | A | 10/2015 |

*Primary Examiner* — Lamson D Nguyen

(74) *Attorney, Agent, or Firm* — Workman Nydegger

(57) ABSTRACT

A printing apparatus includes a printing unit that prints on a roll paper, a transporting unit that transports the roll paper having been printed on along a transport surface, and a drying unit that performs a drying process (post-process) on the roll paper on the transport surface. The drying unit includes a cover (casing) that covers the roll paper on the transport surface. The cover has an inspection window that allows the roll paper on the transport surface to be visually inspected.

7 Claims, 4 Drawing Sheets

PRINTING APPARATUS

BACKGROUND

1. Technical Field

The present invention relates to a printing apparatus that includes a post-process unit that functions after a printing process.

2. Related Art

In many serial type ink jet printers, a movement region of a carriage that carries thereon an ink jet head and that moves back and forth is covered by a cover. JP-A-2007-105927 describes a recording apparatus (printing apparatus) that includes such a cover, a window formed in the cover, and a light-emitting element that illuminates a recorded (printed) area. This recording apparatus allows a printed area being subjected to a recording operation to be visually observed, so that how printing is being performed can be easily visually inspected.

JP-A-2015-178261 describes an ink jet printer that includes a heater device covered by a cover and that heats a recording medium (printing medium) and ink so that the ink is fixed to the recording medium.

In a printing apparatus that includes a post-process unit, such as a heater device, that functions after a printing process, it sometimes happens that the printing medium changes in shape so as to be likely to be jammed or that the state of print, such as the color thereof, changes, depending on the content of the post-process or the configuration of the post-process unit. While the recording apparatus described in JP-A-2007-105927 allows the state of print after printing to be visually inspected, a recording apparatus provided with a post-process unit, such as a covered heater device as described in JP-A-2015-178261, has a problem that it is sometimes the case that the post-process unit blocks the view of the printing medium so that the state of the printing medium during the post-process cannot be visually inspected or is hard to visually inspect. As a result, for example, in the case where the post-process is performed in an inappropriate manner or where the printing medium is damaged due to jamming or the like, such a problem is not promptly coped with but a large quantity of expensive printing media is wasted or the printing efficiency decreases.

SUMMARY

An advantage of an aspect of the invention is that a printing apparatus that at least partially solves the above-stated problem is provided.

An aspect of the invention provides a printing apparatus that includes a printing unit that prints on a printing medium, a transporting unit that transports the printing medium having been printed on along a transport surface, and a post-process unit that performs a post-process on the printing medium on the transport surface. The post-process unit includes a cover that covers the printing medium on the transport surface. The cover has an inspection window that allows the printing medium on the transport surface to be visually inspected.

According to the foregoing printing apparatus of the invention, since, in the post-process unit, the cover that covers the printing medium on the transport surface is provided with the inspection window that allows the printing medium on the transport surface to be visually inspected, it is possible to check the state of the printing medium (how the state of print is changing, the transport state of the printing medium, etc.) during the post-process.

In the foregoing printing apparatus of the invention, the post-process unit may include a heating unit that performs a heating process on the printing medium, and the cover may be provided so as to cover the heating unit.

According to this embodiment, since the post-process unit includes the heating unit that performs the heating process on the printing medium, it is possible to dry the printing medium having been printed on and fix the ink to the printed surface.

Furthermore, since the cover provided so as to cover the heating unit is provided with the inspection window that allows the printing medium on the transport surface to be visually inspected, it is possible to check the state of the printing medium (how the state of print is changing, the transport state of the printing medium, etc.) during the heating process.

In the foregoing printing apparatus according to the invention, the post-process unit may include a radiating unit that radiates an electromagnetic wave to the printing medium and the cover may be provided so as to cover the radiating unit.

According to this embodiment, since the post-process unit includes the radiating unit that radiates an electromagnetic wave to the printing medium, the drying of the printed printing medium and the fixation of the ink to the printed surface can be carried out, for example, in the case where the electromagnetic wave is infrared light. Furthermore, in the case where the electromagnetic wave is ultraviolet light, an ultraviolet-curable ink, when such an ink is used, can be cured and fixed to the printed surface.

Furthermore, since the cover provided so as to cover the radiating unit is provided with the inspection window that allows the printing medium on the transport surface to be visually inspected, it is possible to check the state of the printing medium (how the state of print is changing, the transport state of the printing medium, etc.) during the electromagnetic wave irradiation process.

In the foregoing printing apparatus according to the invention, the post-process unit may be provided with a shutter capable of covering the inspection window.

According to this embodiment, since the post-process unit is provided with the shutter capable of covering the inspection window provided in the cover that covers the printing medium on the transport surface, the inspection window can be covered with the shutter when there is no need to check the printing medium on the transport surface. As a result, for example, when an uncovered state of the inspection window has influence on the post-process, that influence can be inhibited by the shutter.

In the foregoing printing apparatus according to the invention, a plurality of the inspection window may be provided.

According to this embodiment, since, in the post-process unit, the cover that covers the printing medium on the transport surface is provided with a plurality of inspection windows, inspection windows through which the printing medium can be more easily visually inspected can be selected. For example, when the printing apparatus handles printing media of different sizes, the state of any one of the printing media during the post-process can be checked from a more appropriate location in accordance with the size of the currently handled printing medium.

In the foregoing printing apparatus of the invention, the inspection window may have a transparent plate member.

According to this embodiment, since the inspection window provided in the cover of the post-process unit is formed by the transparent plate member, the atmospheres outside and inside the cover can be blocked from each other by the transparent plate member. For example, in the case where the inspection window, when open, influences the drying process, that influence can be inhibited.

In the foregoing printing apparatus, the transparent plate member may be provided so as to extend in a direction that intersects a horizontal direction.

According to this embodiment, since the transparent plate member that forms the inspection window in the cover of the post-process unit is provided so as to extend in a direction that intersects a horizontal direction, the transparent plate member, for example, when fogged by condensation of water vapor produced due to the post-process performed on the printing medium having been printed on, allows condensed water drops to easily flow down. This substantially avoids a situation where drops of water condensed on the transparent plate member make it difficult to check the state of the printing medium.

The foregoing printing apparatus may further include a wiper that wipes a surface of the transparent plate member which faces the transport surface.

According to this embodiment, since the wiper for wiping the surface of the transparent plate member of the inspection window is provided, condensed water drops on the surface can be wiped, for example, when the transparent plate member is fogged by water drops formed as a result of the post-process performed on the printing medium that has been printed on. This avoids a situation where drops of water condensed on the transparent plate member make it difficult to check the state of the printing medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
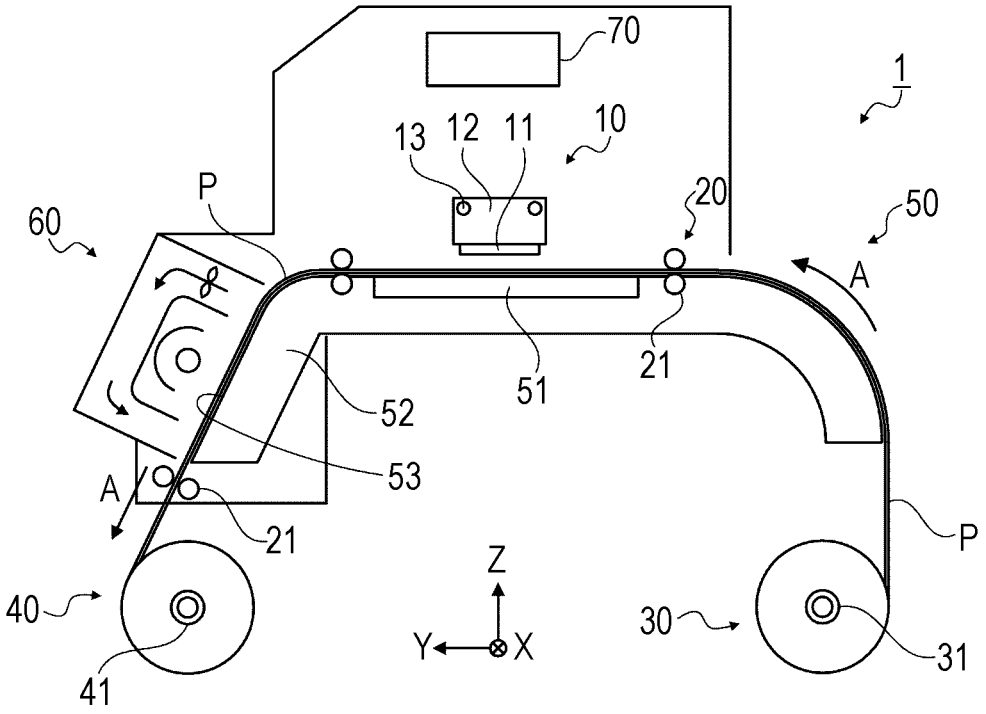
FIG. 1 is a schematic side view of a printing apparatus according to Exemplary Embodiment 1 of the invention.

Exemplary embodiments of the invention will be described hereinafter with reference to the accompanying drawings. The exemplary embodiments and the like described below are merely illustrative and do not limit the invention. Note that the drawings referred to below may employ scales of drawing that do not represent actual measurements for the sake of facilitating illustration. With regard to coordinates indicated in the drawings, Z axis directions represent up-down directions, with the positive Z direction representing an upward direction, Y axis directions represent front/rear directions, with the positive Y direction representing the front direction, and X axis directions represent left/right directions, with the positive X direction representing the left direction. An X-Y plane represents a horizontal plane.

Exemplary Embodiment 1

Figure 2:
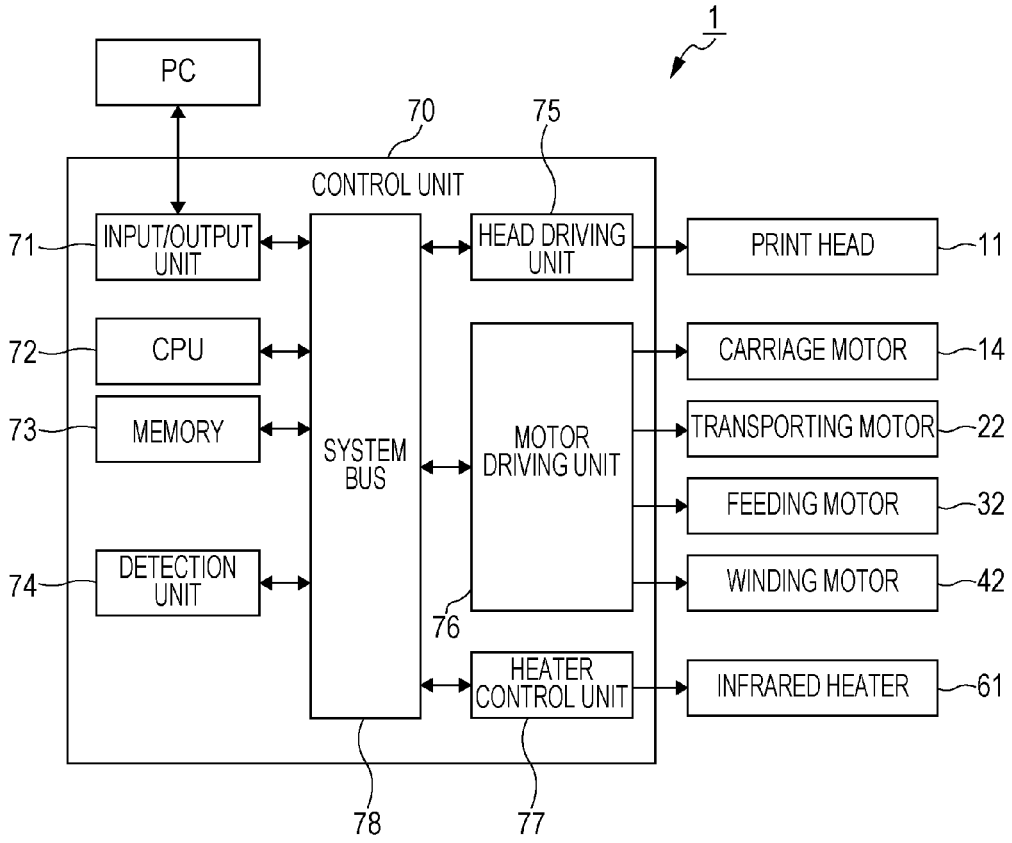
FIG. 2 is a block diagram of the printing apparatus according to Exemplary Embodiment 1.

FIG. 1 is a schematic side view of a printing apparatus 1 according to Exemplary Embodiment 1 of the invention. FIG. 2 is a block diagram of the printing apparatus 1.

The printing apparatus 1 is an ink jet printer capable of being supplied from outside with a roll of paper, one form of a "printing medium", and printing by ejecting ink onto the roll paper P unrolled from the roll.

The printing apparatus 1 includes a printing unit 10 that prints on the roll paper P, a transporting unit 20 that transports the roll paper P, a supplying unit 30, a winding unit 40, a transport path 50, a drying unit 60 that performs a drying process as a "post-process" on the printed roll paper P, a control unit 70, etc.

The roll paper P is unrolled and supplied from the supplying unit 30, transported along the transport path 50 via the printing unit 10 at the time of printing, and housed into the winding unit 40.

Examples of the roll paper P that can be used in this printing apparatus 1 include pure paper, cast paper, art paper, coated paper, synthetic paper, etc. Furthermore, instead of paper, films made of polyethylene terephthalate (PET), polypropylene (PP), etc. may also be used as printing media.

The printing unit 10 is made up of a print head 11, a carriage 12, a guide shaft 13, etc. The print head 11 is an ink jet head that has a plurality of nozzles that eject ink drops. The guide shaft 13 extends in scanning directions (the X axis directions in FIG. 1) that intersect (ideally, orthogonally intersect) a transport direction A in which the roll paper P is moved. The carriage 12, on which the print head 11 is mounted, undergoes back and forth movements (scanning movements) along the guide shaft 13 due to a carriage motor 14 (see FIG. 2) that is driven and controlled by the control unit 70.

The control unit 70 combines an operation of ejecting ink drops from the print head 11 while moving the carriage 12 in the scanning directions and a transport operation of moving the roll paper P in the transport direction A by using the transporting unit 20, so as to form (print) a desired image on the roll paper P.

Although in this exemplary embodiment, the printing unit 10 is a serial head that moves back and forth in the scanning directions, the printing apparatus of the invention may instead be provided with a line head in which nozzles for ejecting ink are arranged along a direction that intersects the transport direction A, over a range in which the roll paper P is allowed to be set. Furthermore, the printing apparatus may include a printing unit other than the so-called ink jet print heads as mentioned above.

The transporting unit 20 is a transporting mechanism that moves the roll paper P in the transport direction A along the transport path 50, and is made up of a plurality of driving rollers 21 together with nip rollers. The driving rollers 21 are driven with the roll paper P pinched between the driving rollers 21 and the nip rollers, so that the roll paper P is transported.

The driving rollers 21 are driven by a transporting motor 22 (see FIG. 2) that is driven and controlled by the control unit 70.

Incidentally, the transporting unit 20 is not limited to a configuration based on these rollers but may instead be configured by employing, for example, a transport belt and the like.

The supplying unit 30 is a housing portion that houses the roll paper P that is yet to be printed on. The supplying unit 30 is located downstream of the printing unit 10 along the transport path 50 and includes a feeding shaft 31 and the like.

By the feeding motor 32 (see FIG. 2) that is driven and controlled by the control unit 70, the feeding shaft 31 is rotated to feed out the roll paper P set as mentioned above toward the printing unit 10, which is disposed downstream of the supplying unit 30.

The winding unit 40 is a housing portion that winds up the roll paper P having been printed on and stores the roll paper P in the form of a wound roll. The winding unit 40 is located downstream of the printing unit 10 on the transport path 50, and includes a winding shaft 41 and the like.

The winding shaft 41 is rotated by the winding motor 42 (see FIG. 2) that is driven and controlled by the control unit 70 so as to wind up the roll paper P transported via the printing unit 10.

The transport path 50 is a transport pathway along which the roll paper P is transported from the supplying unit 30 to the winding unit 40 via the printing unit 10, and includes a medium support unit 52 that includes a platen 51 that supports the roll paper P in a print area of the printing unit 10.

The drying unit 60 is a "post-process unit" that performs drying as an example of the "post-process" on the roll paper P that has been printed on. The drying unit 60 is located along the transport path 50 downstream of the printing unit 10 and upstream of the winding unit 40. Concretely, when a water-based ink or a heat-curable ink is used for printing, the drying unit 60 heats the roll paper P provided with ink drops so as to thermally dry or thermally cure the ink drops while the roll paper P is being transported. The medium support unit 52 includes a transport surface 53 that supports the roll paper P in a portion of the transport path 50 that the medium support unit 52 forms, more specifically, in a region downstream of the printing unit 10 and upstream of the winding unit 40. The transporting unit 20 transports the printed roll paper P along the transport surface 53. The drying unit 60 performs a drying process on the roll paper P on the transport surface 53.

The configuration of the drying unit 60 will be described later.

The control unit 70, as illustrated in FIG. 2, an input/output unit 71, a central processing unit (CPU) 72, a memory 73, a detection unit 74, a head driving unit 75, a motor driving unit 76, a heater control unit 77, a system bus 78, etc. The control unit 70 performs central control of the entire printing apparatus 1.

The input/output unit 71 functions to realize the sending and receiving of data between the printing apparatus 1 and external appliances (e.g., a personal computer (PC)).

The CPU 72 is a processor apparatus for performing overall control of the printing apparatus 1 and is connected via a system bus 78 to the input/output unit 71, the memory 73, the detection unit 74, the head driving unit 75, the motor driving unit 76, and the heater control unit 77.

The memory 73 is an area for storing programs that the CPU 72 operates or recording necessary information, and is made up of a memory element such as a random access memory (RAM), a read-only memory (ROM), a flash memory, etc.

The CPU 72 controls the head driving unit 75, the motor driving unit 76, and the heater control unit 77 in accordance with a program stored in the memory 73 or a print job (print instruction) received from an external appliance.

The detection unit 74 is made up of a plurality of detector appliance groups (e.g., a linear encoder, a rotary encoder, an optical sensor, a temperature sensor, etc.) provided at predetermined locations within the printing apparatus 1, for example, at the printing unit 10, the transporting unit 20, the supplying unit 30, the winding unit 40, the transport path 50, and the drying unit 60. The detection unit 74 detects (monitors) the status of operation in the printing apparatus 1 and outputs a result of detection to the control unit 70. Concretely, the detection unit 74 monitors the position of the carriage 12 that moves back and forth along the guide shaft 13, the set position of the roll paper P in its width direction on the transport path 50 and the transport status (presence or absence of jam, etc.), the presence or absence or the remaining amount of the roll paper P, the presence or absence or the remaining amount of ink in the printing unit 10, the temperature of the drying unit 60, etc.

Figure 3:
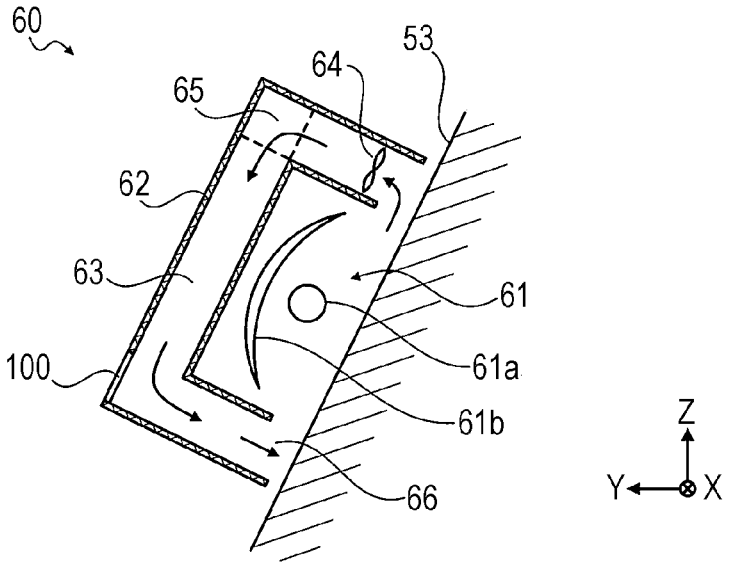
FIG. 3 is a schematic diagram for describing a configuration of portions of a drying unit.

FIG. 3 is a schematic diagram for describing a configuration of portions of the drying unit 60 that characterize this exemplary embodiment.

The drying unit 60 is made up of an infrared heater 61, a casing 62, a duct 63, a suction fan 64, a liquefaction chamber 65, an inspection window 100, etc. The drying unit 60 is provided so as to face the roll paper P transported along the transport surface 53 that is an inclined surface when the printing apparatus 1 is placed on a horizontal plane. The drying unit 60 (infrared heater 61) is controlled by the control unit 70 (the heater control unit 77 (see FIG. 2)).

The infrared heater 61 is a "heating unit" for performing a heating and drying process on the roll paper P, and is made up of an infrared radiating unit 61*a*, a reflector plate 61*b*, etc. The reflector plate 61*b* is disposed so that, in addition to direct light from the infrared radiating unit 61*a*, reflected light from the reflector plate 61*b* is delivered to the roll paper P transporting on the transport surface 53. That is, in this exemplary embodiment, the infrared heater 61 is a "heating unit", and includes a "radiating unit" that radiates infrared light as an electromagnetic wave.

The casing 62 is a base body that supports therein the infrared heater 61, and is provided so as to cover the infrared heater 61. That is, the casing 62 functions also as a "cover" that covers the roll paper P on the transport surface 53 in a drying region in which the roll paper P is dried.

Within the casing 62 there is the duct 63 in which the suction fan 64 and the liquefaction chamber 65 are provided.

The suction fan 64 is disposed so as to draw, together with atmosphere gas, evaporated gas (water vapor in the case where water-based ink is used) that occurs when the roll paper P on the transport surface 53 is thermally dried and to direct the gas to the liquefaction chamber 65 provided within the duct 63. The suction fan 64 is provided at a relatively high location within the duct 63 above the transport surface 53 (which is a location at the upstream side in the transport direction A of the roll paper P).

The liquefaction chamber 65 has a function of liquefying an introduced evaporated gas (water vapor in the case where water-based ink is used) (function of collecting water in the case where water-based ink is used), and sends out the resultant gas (gas from which the evaporated gas has been liquefied) toward a discharge port 66 of the duct 63 (toward the opposite side of the duct 63 to the side provided with the suction fan 64). The gas sent out from the liquefaction chamber 65 is blown from the discharge port 66 to the roll paper P on the transport surface 53. The air blown from the discharge port 66 also accelerates the drying of the roll paper P.

Details of the liquefaction chamber 65 (details of the liquefying function (dehumidifying function)) are omitted.

The inspection window 100 is an opening window that is provided in the casing 62 that allows the roll paper P on the transport surface 53 to be visually inspected. A transparent plate member is fitted to an opening portion of the inspection window 100 so as to prevent leakage of the gas that is blown toward the roll paper P (the gas sent out from the liquefaction chamber 65). It is preferable that the transparent plate member used to form the inspection window 100 be a heat-resistant glass plate that has high light transmission. However, this is not restrictive. For example, the transparent plate member of the inspection window 100 may be a transparent resin plate or the like.

The transparent plate member that forms the inspection window 100 is provided so as to extend in a direction that intersects a horizontal direction and that corresponds to the inclination of the casing 62. It is preferable that an inclination angle of the transparent plate member of the inspection window 100 be oblique to the horizontal direction although the inclination angle does not need to be equal to the inclination angle of the casing 62. For example, the transparent plate member of the inspection window 100 may be provided so as to extend in a vertical direction to make it easier to visually inspect the roll paper P.

The inspection window 100 is provided at a location on the casing 62 at which the inspection window 100 allows visual inspection of the roll paper P prior to completion of the drying process. Concretely, as illustrated in FIG. 3, the inspection window 100 is provided at such a location that, through the inspection window 100, a user looks down, in a direction from outside the casing 62 through a discharge port 66 of the duct 63, at the roll paper P on the transport surface 53. Note that the location on the casing 62 at which the inspection window 100 is provided is not limited to the location as described above. It suffices that the location of the inspection window 100 is at least such that the roll paper P prior to completion of the drying process can be visually inspected through the inspection window 100. It is more preferable that the inspection window 100 be provided at such a location and have such a size as to allow a user to have a view over a region that covers an intermediate part to completion of the drying process, and it is most preferable that the inspection window 100 be provided at such a location and have such a size as to allow a user to have a view over a region that covers the start to completion of the drying process.

Figure 4:
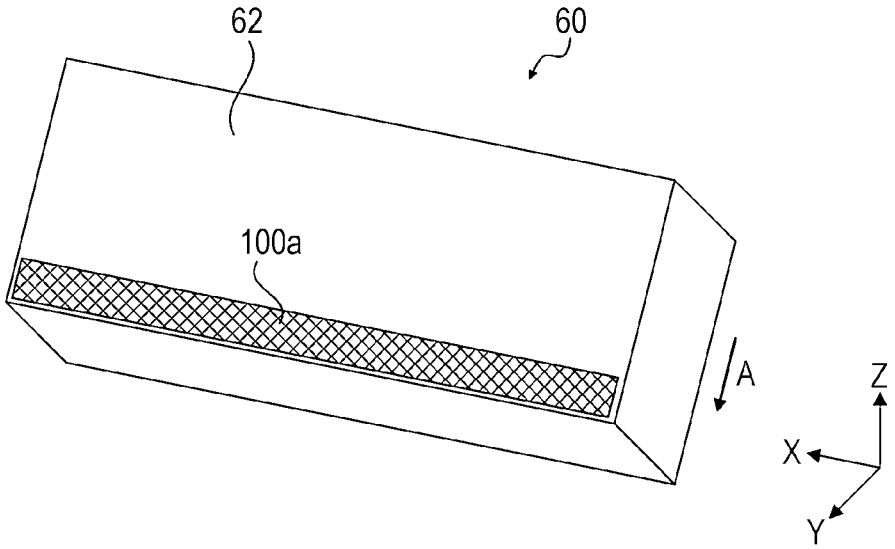
FIG. 4 is a perspective view illustrating an example of a location at which an inspection window is provided.
Figure 5:
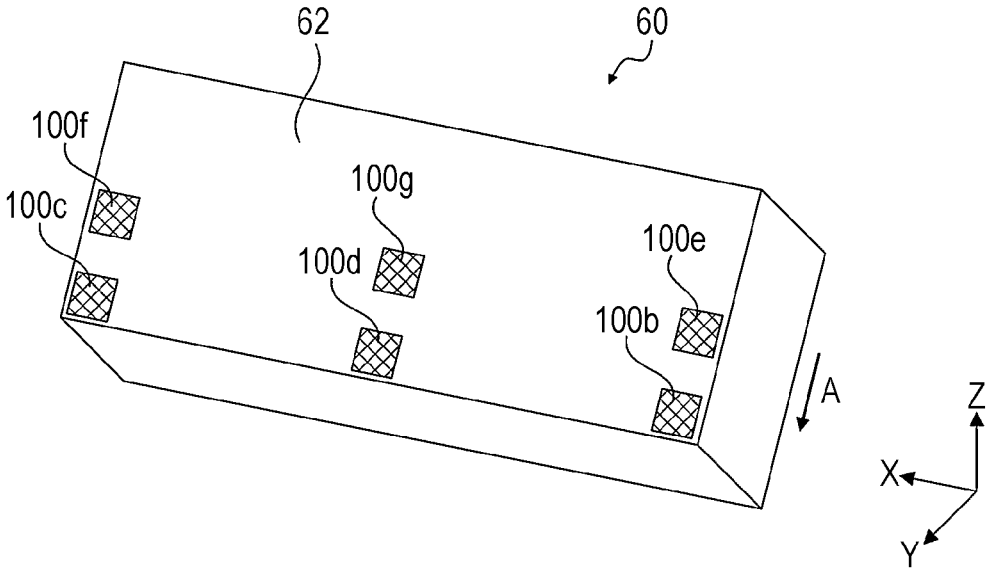
FIG. 5 is a perspective view illustrating examples of the location at which the inspection window is provided.

FIG. 4 and FIG. 5 are perspective views illustrating examples of locations at which the inspection window 100 is provided. The examples of the location of the inspection window 100 are indicated in FIGS. 4 and 5 as inspection windows 100*a* to 100*g*.

For one example, an inspection window 100*a* is illustrated in FIG. 4 which is formed over substantially the entire width of the casing 62 corresponding to a width of the discharge port 66 of the duct 63 which extends over the entire width of the roll paper P (the entire dimension thereof in the X axis direction).

For other examples, inspection windows 100*b* to 100*d* are illustrated in FIG. 5 which are provided, instead of over the entire width of the casing 62 as in the case of the inspection window 100*a*, in a negative X-side end portion of the casing 62 (inspection window 100*b*), a positive X-side end portion of the casing 62 (inspection window 100*c*), and in a central portion of the casing 62 along the X axis (inspection window 100*d*).

For still other examples, inspection windows 100*e* to 100*g* are illustrated in FIG. 5 which are provided in a central portion of the casing 62 in the transport direction A of the roll paper P, instead of at the downstream side of the casing 62 in the transport direction A as in the case of the inspection windows 100*a* to 100*d*. These examples are advantageous when the duct 63 and the infrared heater 61 within the casing 62 are provided so as not to block the view of the roll paper P on the transport surface 53 taken through the inspection window (100*e* to 100*g*).

The number of inspection windows 100 provided on the casing 62 is not limited to one. For example, two or more of the inspection windows 100*a* to 100*g* may be provided on the casing 62, at the locations as illustrated. For example, when the printing apparatus 1 is capable of handling different sizes (widths (measurements in the transverse direction)) of roll papers P, it is preferable that two or more inspection windows be provided at locations on the casing 62 that correspond to the locations at which the roll papers P of the different sizes are set so that the roll paper P of any one of the sizes can be visually inspected.

The shape of the inspection window 100 does not need to be square or rectangular as illustrated in FIGS. 4 and 5 but may also be, for example, circular of elliptic.

Furthermore, for example, when the liquefaction of evaporated gas (dehumidification) in the liquefaction chamber 65 is not sufficiently carried out so that dew condensation occurs on the transparent plate member of the inspection window 100, decreasing visibility, it is preferable to provide the inspection window 100 with a wiper for removing condensed dew. It suffices that the wiper is provided so as to be manually operated to wipe the surface of the transparent plate member which faces the transport surface 53 (i.e., the condensation surface thereof) by using a lever that is provided outside the casing 62 and that is operably connected to the wiper.

The foregoing exemplary embodiment of the printing apparatus of the invention can achieve the following advantageous effects.

Since, in the drying unit 60, the cover (casing 62) that covers the roll paper P on the transport surface 53 is provided with the inspection window 100 through which the roll paper P on the transport surface 53 can be visually inspected, it is possible to check the state of the roll paper P during the drying process (how the state of print is changing, the state of transport of the roll paper P, etc.). Therefore, for example, when the drying process is performed according to inappropriate specifications or when the roll paper P has been damaged due to jam or the like, such a problem can be coped with at an early stage, so that waste of a large amount of expensive printing medium or reduction of printing efficiency can be inhibited.

Furthermore, since the drying unit 60 includes the infrared heater 61 that performs the heating process on the roll paper P, the drying of the roll paper P having been printed on and the fixation of the ink to the printed surface can be carried out.

Furthermore, since the cover (casing 62) that covers the infrared heater 61 is provided with the inspection window 100 through which the roll paper P on the transport surface 53 can be visually inspected, it is possible to check the state of the roll paper P (how the state of print is changing, the state of transport of the roll paper P, etc.) during the heating process.

Furthermore, in the case where, in the drying unit 60, the cover (casing 62) that covers the roll paper P on the transport surface 53 is provided with a plurality of inspection windows 100, inspection windows 100 through which the roll paper P can be more easily visually inspected can be selected. For example, when the printing apparatus 1 handles roll papers P of different sizes, the state of the roll paper P of any one of the sizes during the post-process can be checked from a more appropriate location (through a more appropriate inspection window) in accordance with the size of the roll paper P.

Furthermore, since the inspection window 100 formed in the cover of the drying unit 60 is made of a transparent plate member, the transparent plate member can block the atmospheres outside and inside the cover (casing 62). For example, in the case where the inspection window 100, when open, influences the drying process, that influence can be inhibited.

Furthermore, since the transparent plate member that forms the inspection window 100 in the cover of the drying unit 60 is provided so as to extend in a direction that intersects a horizontal direction, the transparent plate member, for example, when fogged by condensation of water vapor produced due to the drying process performed on the printed roll paper P, allows condensed water drops to easily flow down. This substantially avoids a situation where drops of water condensed on the transparent plate member make it difficult to check the state of the roll paper P.

Furthermore, in the case where the drying unit 60 is provided with a wiper for wiping the surface of the transparent plate member of the inspection window 100 which faces the transport surface 53, condensed water drops on the surface can be wiped, for example, when the transparent plate member is fogged by water drops formed as a result of the drying process performed on the printed roll paper P. This substantially avoids a situation where drops of water condensed on the transparent plate member make it difficult to check the state of the roll paper P.

Note that although the printing apparatus 1 of this exemplary embodiment is configured to print on the roll type printing medium (roll paper P), the printing apparatus of the invention is not limited to such a configuration but may be configured to print on a cut sheet-shaped printing medium. When the printing apparatus is configured to print on the cut sheet-shaped printing medium, the printing apparatus employs as a printing medium supplying unit, for example, a sheet feeding (feeder) tray, a sheet feeding (feeder) cassette, etc. Furthermore, the printing apparatus employ as a printing medium collecting unit, for example, a sheet discharging (discharge) tray, a sheet discharging (discharge) cassette, etc.

Furthermore, for example, when the gas sent out from the liquefaction chamber 65 does not adversely affect humans (in terms of the temperature or components of the gas) or when the gas sent out from the liquefaction chamber 65 poses no problem if the gas leaks out from the inspection window 100, the inspection window 100 does not need be provided with a transparent plate member but may be a simple opening window.

Furthermore, the drying unit 60 may employ as a "heating unit" an electrically heating wire from which warm air is blown by a blower fan or the like to the roll paper P transported along the transport surface 53.

Furthermore, it is desirable to provide within the casing 62 an illumination device (e.g., light-emitting diode (LED) illumination device) that facilitates the viewing of a region in which the roll paper P on the transport surface 53 can be visually inspected through the inspection window 100.

Furthermore, for example, when the inspection window 100 provides only a small field of view for looking straight at the roll paper P on the transport surface 53, the field of view may be increased by using a reflecting mirror or a reflecting prism.

Exemplary Embodiment 2

Next, a printing apparatus 2 according to Exemplary Embodiment 2 will be described. Note that, in the following description, the same component portions and the like as in the foregoing exemplary embodiment are referenced by the same reference characters and are not redundantly described.

The printing apparatus 2 is an ink jet printer that prints by using an ultraviolet-curable ink and includes a drying unit 60*u* that radiates ultraviolet light to cure and fix the ink as a "post-process unit", instead of the drying unit 60 that performs thermal drying in the printing apparatus 1. Except for this feature, the printing apparatus 2 is the same as the printing apparatus 1.

Figure 6:
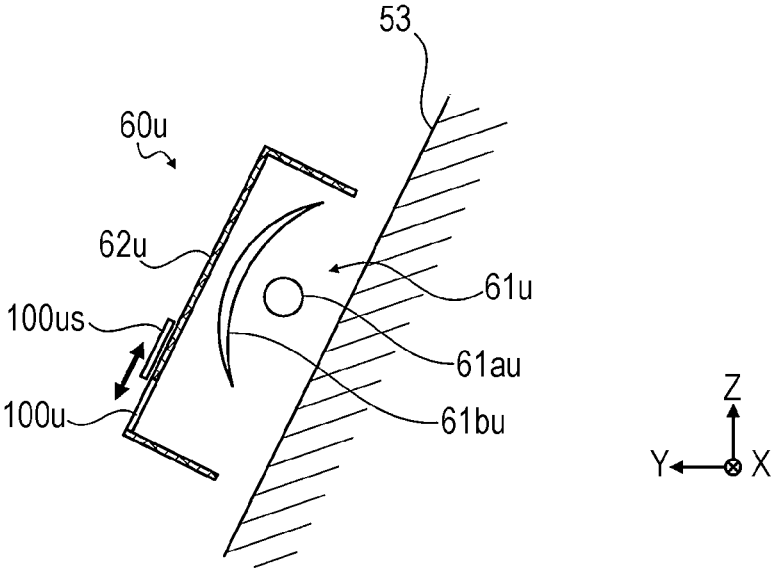
FIG. 6 is a schematic diagram for describing a configuration of portions of a drying unit according to Exemplary Embodiment 2 of the invention.

FIG. 6 is a schematic diagram for describing a configuration of portions of the drying unit 60*u* provided in the printing apparatus 2 according to Exemplary Embodiment 2.

The drying unit 60*u* includes an ultraviolet radiator 61*u*, a casing 62*u*, an inspection window 100*u*, etc. The drying unit 60*u* is provided in the printing apparatus 2 so that, when the printing apparatus 2 is placed on a horizontal plane, the drying unit 60*u* faces the roll paper P transported along the transport surface 53 that is an inclined surface.

The ultraviolet radiator 61*u* includes an ultraviolet radiating unit 61*au*, a reflector plate 61*bu*, etc. and radiates ultraviolet light to the roll paper P that has been printed on. The reflector plate 61*bu* is disposed so that reflected light from the reflector plate 61*bu* in addition to light from the ultraviolet radiating unit 61*au* is radiated to the roll paper P transported on the transport surface 53. That is, in this exemplary embodiment, the drying unit 60*u* includes a "radiating unit" that radiates ultraviolet light as an electromagnetic wave.

The inspection window 100*u* is an opening window which is provided in the casing 62*u* so as to allow the roll paper P on the transport surface 53 to be visually inspected and to whose opening portion a transparent plate member is fitted. It is preferable that the transparent plate member that forms the inspection window 100*u* be a glass plate that has a high transmission of visible light and a low transmittance of ultraviolet. However, this is not essential to the invention. For example, the transparent plate member of the inspection window 100*u* may also be a transparent resin plate that has substantially the same characteristics as mentioned above.

As for the location of the inspection window 100*u* on the casing 62*u*, the inspection window 100*u* is located so that the roll paper P prior to completion of the ink curing process caused by ultraviolet irradiation can be visually inspected through the inspection window 100*u*. Concretely, as illustrated in FIG. 6, the inspection window 100*u* is provided at a location that is at a downstream side of the reflector plate 61*bu* in the transport direction A of the roll paper P so that a view of the roll paper P obtained through the inspection window 100*u* is not blocked by the reflector plate 61*bu*. Note that the location of the inspection window 100*u* on the casing 62*u* is not limited to the foregoing location. It suffices that the location of the inspection window 100*u* is at least such that the roll paper P prior to completion of the ultraviolet curing process can be visually inspected through the inspection window 100*u*. It is more preferable that the inspection window 100*u* be provided at such a location and have such a size as to allow a user to have a view over a region that covers an intermediate part to completion of the ultraviolet curing process, and it is most preferable that the inspection window 100*u* be provided at such a location and have such a size as to allow a user to have a view over a region that covers the start to completion of the ultraviolet curing process.

Furthermore, the drying unit 60*u* is provided with a shutter 100*us* capable of covering the inspection window 100*u*. The shutter 100*us* is made up of a metal plate capable of being manually slid along a surface of the transparent plate member of the inspection window 100*u* so as to cover the entire surface of the inspection window 100*u*.

According to the printing apparatus of this exemplary embodiment, since the drying unit 60*u* includes the ultraviolet radiating unit 61*au* that radiates ultraviolet light to the roll paper P, it is possible to cure an ultraviolet-curable ink and fix the ink onto the printed surface in the case where such an ink is used by the printing apparatus.

Furthermore, since the cover (casing 62*u*) provided so as to cover the ultraviolet radiating unit 61*au* is provided with the inspection window 100*u* through which the roll paper P on the transport surface 53 can be visually inspected, it is possible to check the state of the roll paper P during the ultraviolet irradiation process (how the state of print is changing, the state of transport of the roll paper P, etc.).

Still further, since the drying unit 60*u* is provided with the shutter 100*us* capable of covering the inspection window 100*u*, it is possible to cover the inspection window 100*u* with the shutter 100*us* when there is no need to check the roll paper P on the transport surface 53. As a result, it is possible to inhibit ultraviolet light from leaking out. Furthermore, for example, when an uncovered state of inspection window 100*u* has influence on a post-process (ultraviolet curing process), that influence can be inhibited by the shutter 100*us*.

This application claims priority under 35 U.S.C. § 119 to Japanese Patent Application No. 2016-219430, filed Nov. 10, 2016. The entire disclosure of Japanese Patent Application No. 2016-219430 is hereby incorporated herein by reference.

What is claimed is:

1. A printing apparatus comprising:

a printing unit that prints on a printing medium;

a transporting unit that transports the printing medium having been printed on along a transport surface; and a post-process unit that performs a post-process on the printing medium on the transport surface, wherein the post-process unit includes a cover that covers the printing medium on the transport surface, and wherein the cover has an inspection window that allows the printing medium on the transport surface to be visually inspected.

2. The printing apparatus according to claim 1, wherein the post-process unit includes a heating unit that performs a heating process on the printing medium, and wherein the cover is provided so as to cover the heating unit.

3. The printing apparatus according to claim 1, wherein the post-process unit includes a radiating unit that radiates an electromagnetic wave to the printing medium, and wherein the cover is provided so as to cover the radiating unit.

4. The printing apparatus according to claim 1, wherein the post-process unit is provided with a shutter capable of covering the inspection window.

5. The printing apparatus according to claim 1, wherein the inspection window is one of a plurality of inspection windows provided in the cover.

6. The printing apparatus according to claim 1, wherein the inspection window has a transparent plate member.

7. The printing apparatus according to claim 6, wherein the transparent plate member is provided so as to extend in a direction that intersects a horizontal direction.

* * * * *